US005467879A

United States Patent [19]

Moore

[11] Patent Number: 5,467,879

[45] Date of Patent: Nov. 21, 1995

[54] LINERLESS CLOSURE AND FITMENT ASSEMBLY

[76] Inventor: David N. Moore, 23144 W. Lee St., Plainfield, Ill. 60544

[21] Appl. No.: 160,572

[22] Filed: Dec. 1, 1993

[51] Int. Cl.[6] ..... B65D 51/20; B65D 41/62

[52] U.S. Cl. ..... 215/253; 215/277; 220/259; 222/565; 222/480

[58] Field of Search ..... 215/250, 253, 215/277, 317; 220/254, 256, 265, 266, 259; 222/565, 480, 482, 541, 556; D7/590, 591, 594, 596, 597, 599; D9/515, 435, 445, 447, 449

[56] References Cited

U.S. PATENT DOCUMENTS

| | | | |
|---|---|---|---|
| 3,467,287 | 9/1969 | Marchant et al. . | |
| 3,469,748 | 9/1969 | Meyers . | |
| 3,499,588 | 3/1970 | Bartilson et al. . | |
| 4,003,506 | 1/1977 | Fuchs . | |
| 4,047,647 | 9/1977 | Lewis | 222/480 |
| 4,120,432 | 10/1978 | Fuchs . | |
| 4,361,250 | 11/1982 | Foster | 22/541 X |
| 4,437,593 | 3/1984 | Bullock, III . | |
| 4,500,016 | 2/1985 | Funfstuck . | |
| 4,585,151 | 4/1986 | Luker . | |
| 4,714,181 | 12/1987 | Kozlowski et al. . | |
| 4,823,995 | 4/1989 | Lewis . | |
| 4,901,892 | 2/1990 | Song . | |
| 4,911,337 | 3/1990 | Rosenthal . | |
| 5,139,181 | 8/1992 | VerWeyst | 222/556 X |
| 5,183,171 | 2/1993 | Pherigo | 215/277 X |
| 5,184,746 | 2/1993 | Moore et al. | 215/277 X |

FOREIGN PATENT DOCUMENTS

| | | | |
|---|---|---|---|
| 575764 | 12/1993 | European Pat. Off. | 222/556 |
| 418257 | 1/1992 | Japan | 222/556 |

*Primary Examiner*—Allan N. Shoap
*Assistant Examiner*—Nathan Newhouse
*Attorney, Agent, or Firm*—Welsh & Katz, Ltd.

[57] ABSTRACT

A linerless closure cap and fitment assembly configured for use with a container having a neck with an annular lip at its uppermost end defining a mouth. The closure cap and fitment assembly includes a fitment with a dispensing surface having a resealable pour spout and possibly sifting holes dimensioned to span the mouth of the container and a cap with a top panel, an annular skirt and threads for releasable engagement onto the neck of the container. The fitment includes a vertical fin along the sides of the pour spout to dam the product within the container, thereby stopping the product from sifting or "dusting" out of the closure during shipment in an upright or upside down position.

4 Claims, 1 Drawing Sheet

LINERLESS CLOSURE AND FITMENT ASSEMBLY

The present invention relates to closures for containers and, more specifically, to a linerless closure and fitment assembly that eliminates dusting of the contents of the container onto the outside of the container during shipment, even in an upside down position.

BACKGROUND OF THE INVENTION

There are currently numerous types of closure assemblies which include a particular fitment for dispensing the contents of a container. Typical dispensing fitments, such as sifter fitments, are designed to snap onto or otherwise engage the mouth of the container and to remain on the container when the closure cap is removed. Such fitments are generally included as part of the container package for a variety of liquid and granular or powdered substances. In addition, most container closure assemblies provided with fitments include a liner that spans the mouth of the container to prevent tampering, leakage or spoilage of the contents of the container.

Shipment without a liner frequently results in the product sifting through the fitment, and escaping from under the cap, commonly referred to as "dusting". The product appears as a fine dust outside the cap and on the outside of the bottle. The amount of product lost is small; however, the impression on the consumer is great. A dusty container is viewed as greatly inferior in quality.

Although a liner eliminates dusting, frequently the lined fitment and closure are sold, distributed and stored separately, prior to assembly upon the container. The assembly of the closure to a container therefore entails several steps. Typically, a liner is applied to the inside of the fitment, the fitment and liner are then applied to the mouth of the container and the closure cap is secured to the container. Because the fitment is applied over the liner and onto the container, the user must normally snap the fitment off, remove the protective liner and then reapply the fitment to the container before being able to dispense the product.

Thus, the handling and assembly costs of currently available closure assemblies are significantly increased when a liner is incorporated as part of the package. Not only are the packaging costs increased by the addition of a liner but the consumer is burdened with trying to remove and subsequently reapply the fitment in order to remove the liner. Often a consumer may simply decide to remove the liner and forego the step of reapplying the fitment. Thus, there is a need for a closure assembly which does not require the use of a liner but still prevents the contents of the container from dusting out of the container during shipment.

SUMMARY OF THE INVENTION

It is, therefore, an object of the invention to provide a linerless closure cap and fitment assembly for use in holding and dispensing spices and other granular, free flowing, friable products in which the fitment and cap are configured to eliminate dusting of the contents onto the outside of the container. Another object of this invention to reduce the cost of assembling the closure cap and fitment onto the container, after filling.

In accordance with the present invention, these objects, as well as others not herein identified are achieved generally by the present closure and fitment assembly, wherein the fitment is configured such that a liner is not required to eliminate dusting of the contents of the container during shipment, even in an upside down position.

More specifically, the present invention includes a closure and fitment assembly configured for use with a container having a neck with an annular lip at its uppermost end defining a mouth. The fitment has a dispensing surface dimensioned to span the mouth of the container with a pour spout and possibly holes for sifting of the product. The pour spout is a door, defined by two cut out sections joined by an integral hinge. The cut out sections of the pour spout each have a fin, or strut, that extends from the top to the bottom of the cut out section. This fin is located near the outside edge of the fitment.

The cap has a top panel, an annular skirt depending peripherally from the top panel and threads for releasable engagement onto the neck of the container. The outer edge of the inner surface of the top panel fits closely against the outer top edge of the fitment dispensing surface contacting the top of the fins within the cut out sections of the pour spout. When the closure is on the container, the fins act as a dam and prevent the contents of the container from dusting out of the closure and onto the outside of the container.

DESCRIPTION OF THE DRAWINGS

Further objects of the invention, taken together with additional features contributing thereto and advantages occurring therefrom, will be apparent from the following description of the invention when read in conjunction with the accompanying drawings, wherein.

DETAILED DESCRIPTION OF THE INVENTION

Figure 1:
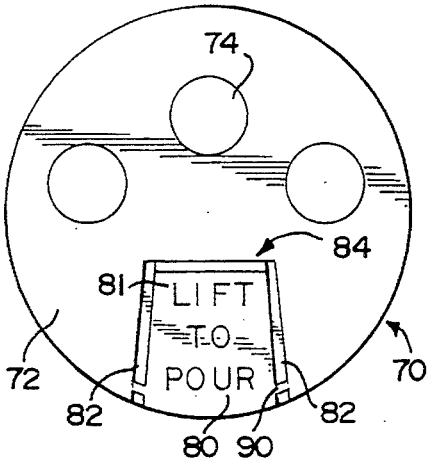
FIG. 1 is a top view of the fitment element of the present invention.

In the drawings, FIGS. 1–4, wherein a preferred embodiment is shown, and wherein similar reference characters designate corresponding parts throughout the several views, 10 generally designates the present closure and fitment assembly.

The closure and fitment assembly 10, is typically designed for use with any type of container 20 used for storing and dispensing granular or powdered substances, liquids or other substances. Although a specific type of container is not required for assembly of the present closure and fitment assembly 10, it is contemplated that the container 20 will include a container neck 22, which may include external threading 24 designed to engage complementary threading on the inside surface of the closure cap 40. The neck 22 terminates at an upper end in an annular lip 26 which defines the container mouth 28. The closure and fitment assembly 10 essentially consists of two portions or sections; a closure cap 40, and a fitment 70.

It is contemplated that the closure cap 40 will be manufactured of any conventional plastic material used for molded closures, such as polypropylene. More particularly, the closure cap 40 includes a top panel 42, having an inner surface 41 and an outer surface 43, a peripheral edge 44, and a depending annular skirt 46 integral with the edge 44. The inner surface 60 of the annular skirt 46 includes threads 62 to complementarily engage the threads 24 formed on the container neck 22.

The shape of the fitment 70 may be of any type generally suitable for dispensing the particular product in the container 20. As shown, the fitment 70 is a conventional sifter used with dispensers for powdered or granular substances such as spices and the like. The fitment 70 is preferably made of a flexible, self supporting plastic material such as polyethylene.

As depicted in FIGS. 1–4, the fitment 70, configured as a sifter, includes a top panel, or sifter dispensing surface 72 of a sufficient diameter to span the mouth 28 of the container 20 it is to be used on. The sifter dispensing surface 72 may have formed therethrough at least one and preferably several sifter dispensing apertures 74. The apertures 74 shown in the drawings as circular in shape, are generally perpendicular in respect to the sifter dispensing surface 72, or they can be configured at various angles, sizes and shapes depending on the type and volume of the container contents to be dispensed. The fitment 70 also includes a reclosable pour spout 80 in one side thereof. The pour spout 80 is a door formed by two cutout sections 82 joined by an integral hinge 84 along the back 81 of the pour spout 80. The pour spout 80 can be lifted up allowing the contents of the container to be poured from the container. The pour spout 80 can then be snapped closed when not in use. The cutout sections 82 have a horizontal portion 86 and a vertical portion 88 which join at a corner 87. The fitment 70 includes an annular securing wall 76 depending from and integral with the dispensing surfaces 72. The sifter 70 further includes a fitment retaining bead 78 which is annular and projects radially from an inner surface 77 of the annular securing wall 76. The fitment retaining bead 78 also acts to hold the pour spout 80 in a closed position.

When assembled on the container 20 the inner surface 41 of the top panel 42 lies slightly above the sifter dispensing surface 72 of the fitment 70. The contents of the container 20 can therefore escape from the apertures 74 and from the horizontal portions 86 of the cut out sections 82 of the pour spout 80. The contents can then escape from the closure cap 40 and appear as dust on the outside of the container 20. In general this dusting onto the outside of the container 20 is stopped through the use of a liner. In the present invention this dusting is prevented by two fins or struts 90 located on the horizontal portion 86, near the corners 87 of the cut out sections 82 of the pour spout 80.

Figure 2:
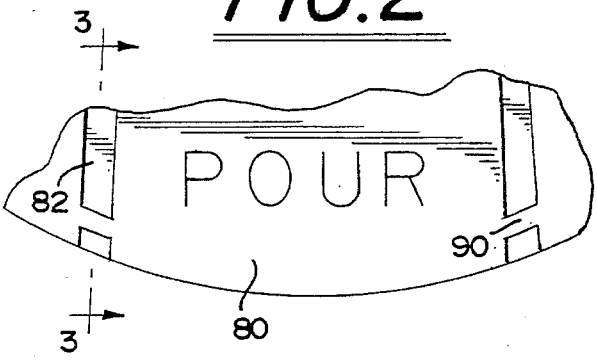
FIG. 2 is a close up top view of the fitment of the present invention showing the position of the fins.
Figure 4:
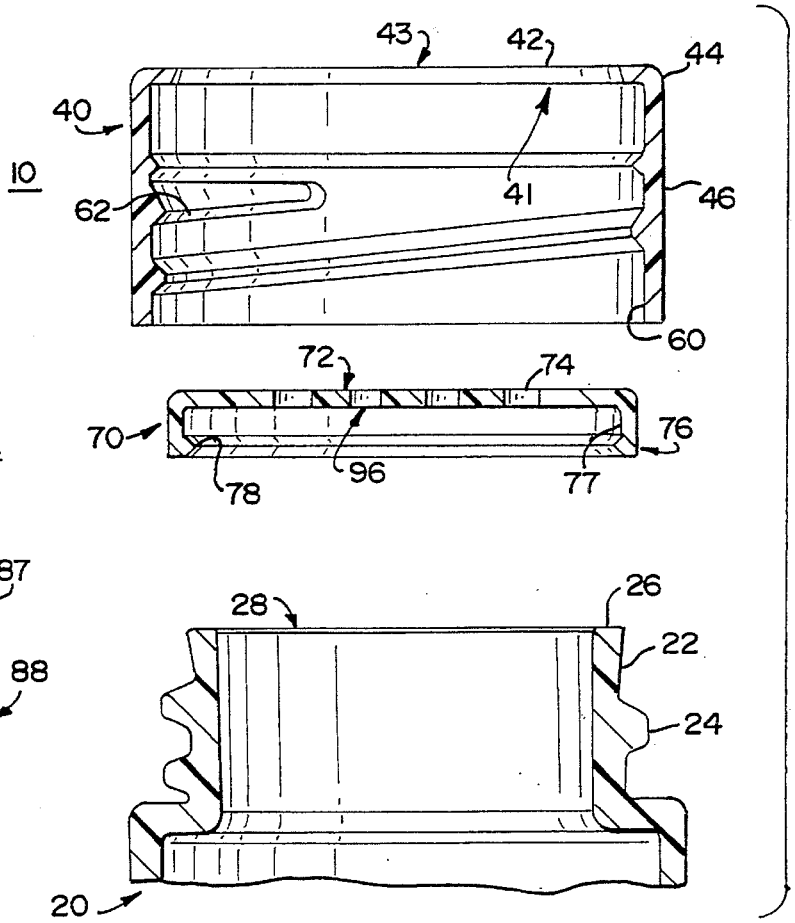
FIG. 4 is an exploded view of the present invention and a container, showing how the assembly fits onto a container.
Figure 3:
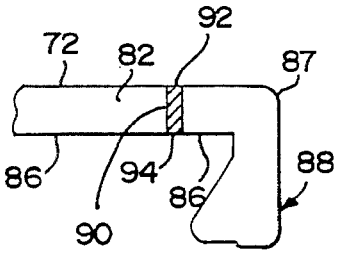
FIG. 3 is a close up side view of the fitment element taken along line 3—3 in FIG. 2.

The fins 90 are shown in FIGS. 1–3. The top 92 of the fins 90 are co-planar with the dispensing surface 72 of the fitment 70. The fins 90 extend through the cut out sections 82 and the bottom 94 of the fins 90 is co-planar with the bottom surface 96 of the fitment 70. When the closure cap 40 is placed in the container 20, the outer edge of the inner surface 41 of the top panel 42 of the closure cap 40 fits tightly against the outer edge of the sifter dispensing surface 72 and contacts the top surface 92 of the fins 90. The tops 92 of the fins 90 form a seal against the inner surface 41 of the top panel 42 of the closure cap 40, while the bottom of the fin 94 forms a seal against the annular lip 26, thereby forming a dam which prevents the contents of the container 20 from escaping from the container 20 and dusting the outside of the container 20 during shipment, even in a upside down position.

The fins 90 are thin enough so that they break when the pour spout 80 is opened. However they are strong enough not to break during shipment. Once the pour spout 80 is opened, the fins 90 will no longer act to stop dusting of the product.

Through the use of the fins 90 in the fitment 70 a liner is no longer necessary to prevent dusting of the contents of the container 20 on the outside of the container 20 and the closure cap 40. The elimination of a liner allows for simpler assembly and a reduction in cost of the capping operation. The cost reduction is due both to the reduced materials and to reduced costs during the capping procedure.

While a preferred embodiment of the invention has been shown and described, it should be understood that there is no intent to limit the inventions by such disclosure, but rather it is intended to cover all modifications and alternative constructions that fall within the spirit and scope of the invention as described in the following claims:

What is claimed is:

1. A closure and fitment assembly in combination with a container for holding desired granular contents;

said container having a neck with an annular lip at an uppermost end of the neck defining a mouth; and said closure and fitment assembly consisting essentially of a closure and a fitment, said fitment being dimensioned to span said mouth of the container, and having an upper dispensing surface, a lower surface, a pouring means, and an annular securing wall depending peripherally from said dispensing surface;

said pouring means comprising two cut out sections, each said cut out section having a vertical end located within said annular securing wall, a first horizontal end located next to said annular securing wall and proceeding to a second horizontal end, said vertical end and said first horizontal end forming a corner;

an integral flexible hinge extending between said second ends of said cut out sections, said hinge allowing a portion of said fitment, located between said cut out sections, to be rotatably moveable about the hinge while said fitment is secured to said container, thereby allowing the contents to be poured from the container;

said closure having a top panel with a planar inner surface, an annular skirt depending peripherally from said top panel and means for releasable engagement onto the neck of said container, each of said cut out sections, prior to opening of said pouring means, having a fin across said cut out section near the first horizontal end thereof, each said fin being located directly above the lip of the container and having a top and a bottom;

the bottom of each said fin being co-planar with the lower surface of said fitment, and the top of each said fin being co-planar with the dispensing surface of said fitment;

whereby, when said closure is in place, the fins act to form a seal with the inner surface of said closure and with the lip of said container, prohibiting the escape of the contents from the closure during shipment.

2. The assembly as described in claim 1, wherein said annular securing wall includes an annular retaining bead disposed on an inner surface of said wall.

3. A closure and fitment assembly configured for use with a container for holding desired contents having a neck with an annular lip at an uppermost end of the neck defining a mouth; said closure and fitment assembly comprising:

a closure a fitment being dimensioned to span the mouth, and having a lower surface, an upper dispensing surface, and a pouring means;

said pouring means having two cut out sections, each of said cut out sections having a first horizontal end and a second horizontal end;

an integral flexible hinge extending between said second horizontal ends of said cut out sections, allowing said first horizontal ends to be lifted to pour the contents from the container;

a pair of fins, one fin in each of said cut out sections and located near said first horizontal end; each said fin having a top and a bottom, the bottom of each said fin being co-planar with the lower surface of said fitment and the top of each said fin being co-planar with the upper dispensing surface of said fitment, to allow formation of a seal with said closure and a seal with the lip of said container; whereby said fins, when the closure is secured to said container, prohibit the escape of the contents outside said closure.

4. A fitment to be used with a closure and a container for holding desired contents having a neck with a lip at an uppermost end of the neck defining a mouth; said fitment spanning the mouth and comprising:

an upper dispensing surface, a bottom surface, and a pouring means;

said pouring means comprising a door; said door having an upper surface and a lower surface and being pivotally connected to said dispensing surface for movement from a closed position to an open position; said door initially secured in said closed position by a strut, said strut having an upper surface and a lower surface, the upper surface of said strut being co-planar with the Upper surface of the door and with the upper dispensing surface of the fitment, the lower surface of said strut being co-planar with the lower surface of the door and with the bottom surface of the fitment, for making a seal with said closure and a seal with said lip, whereby when the closure is in place, said closure prohibits the sifting of the contents from said container.

* * * * *